US006067732A

United States Patent [19]

Dodge

[11] Patent Number: 6,067,732

[45] Date of Patent: May 30, 2000

[54] SHOE CONSTRUCTION WITH STEEL TOE

[75] Inventor: Michael Dodge, Brodhead, Wis.

[73] Assignee: Columbia Insurance Company, Omaha, Nebr.

[21] Appl. No.: 09/273,106

[22] Filed: Mar. 19, 1999

[51] Int. Cl.[7] ..... A43C 13/14; A43D 29/00

[52] U.S. Cl. ..... 36/77 R; 36/72 R; 36/96; 12/146 D

[58] Field of Search ..... 36/77 R, 77 M, 36/96, 113, 72 R; 12/146 D

[56] References Cited

U.S. PATENT DOCUMENTS

| | | | |
|---|---|---|---|
| 986,475 | 3/1911 | Liebmann | 12/146 D |
| 2,358,161 | 9/1944 | Hendricks | 36/77 R |
| 2,746,177 | 5/1956 | Maccarone . | |
| 2,756,519 | 7/1956 | Hill | 36/77 R |
| 2,963,722 | 12/1960 | Stix . | |
| 3,165,841 | 1/1965 | Rollman | 36/77 R |
| 3,348,251 | 10/1967 | Appleton et al. . | |
| 3,555,705 | 1/1971 | Eder et al. . | |
| 3,705,463 | 12/1972 | Lown . | |
| 3,784,053 | 1/1974 | Stout . | |
| 4,146,129 | 3/1979 | Wood . | |
| 4,171,046 | 10/1979 | Bonczyk . | |
| 4,240,545 | 12/1980 | Stout . | |
| 4,253,564 | 3/1981 | Engdahl, Jr. . | |
| 4,257,177 | 3/1981 | Unsted | 12/146 D |
| 4,286,709 | 9/1981 | Manizza . | |
| 4,349,103 | 9/1982 | Wood . | |
| 4,430,767 | 2/1984 | Allard . | |
| 4,662,018 | 5/1987 | Autry . | |
| 4,704,808 | 11/1987 | Bianchini et al. . | |
| 4,811,501 | 3/1989 | Okayasu | 36/77 R |
| 4,927,009 | 5/1990 | Stout . | |
| 4,989,779 | 2/1991 | Lashyro . | |
| 5,579,904 | 12/1996 | Holley, Jr. . | |
| 5,611,425 | 3/1997 | Holley, Jr. . | |
| 5,784,736 | 7/1998 | Issler et al. | 12/142 B |
| 5,893,186 | 4/1999 | Issler et al. . | |

FOREIGN PATENT DOCUMENTS

| | | | |
|---|---|---|---|
| 812386 | 4/1959 | United Kingdom | 36/77 D |

*Primary Examiner*—Paul T. Sewell
*Assistant Examiner*—J. Mohandesi
*Attorney, Agent, or Firm*—Fish & Richardson P.C.

[57] ABSTRACT

Footwear and its method of manufacture are provided. The footwear includes an upper having a vamp lining with a toe part disposed along an inner surface of the upper is provided. A relatively rigid insole forepart member is attached to a sock liner, the length of the insole forepart being less than the length of the sock liner. The toe part of the vamp lining is then stitched to a peripheral edge of the insole forepart, the vamp lining and insole forepart defining a cavity for receiving a portion of a wearer's foot. A steel toe is then positioned substantially around the toe part of the vamp lining.

27 Claims, 7 Drawing Sheets

SHOE CONSTRUCTION WITH STEEL TOE

BACKGROUND OF THE INVENTION

This invention relates generally to footwear and to methods of footwear construction.

Opanka is a type of shoe construction where the shoe upper is hand-sewn, together with a sock liner, to an outsole. An example of a footwear construction which employs, in part, aspects of Opanka construction can be found in U.S. Pat. No. 5,784,736, Method for Construction of Footwear, incorporated herein by reference. The sock liner and a foam cushion are stretched across a cavity formed in the upper surface of the outsole, thus creating a cushiony and flexible "trampoline effect," to provide greater comfort to the wearer. To provide flexibility the Opanka construction does not include an insole. Sandals are commonly made using the Opanka construction.

Safety shoes, on the other hand, are known for their rigid and rugged construction, where comfort is often sacrificed for the benefit of safety. Steel toes for providing rigid protection to a wearer's toes are often required in many safety shoes. The steel toe is incorporated into a shoe by inserting a flange portion of the steel toe under an insole member of the shoe, a component not found in shoes of Opanka construction.

SUMMARY OF THE INVENTION

The invention features footwear and its method of manufacture. The footwear has a construction which is comfortable to wear and includes a steel toe for protecting the wearer's toes from impact when used in harsh environments (e.g., construction sites, factories, etc.).

In one aspect, the method for constructing the footwear includes the following steps. An upper having a vamp lining with a toe part disposed along an inner surface of the upper is provided. A relatively rigid insole forepart member is attached to a sock liner, the length of the insole forepart being less than the length of the sock liner. The toe part of the vamp lining is then stitched to a peripheral edge of the insole forepart, the vamp lining and insole forepart defining a cavity for receiving a portion of a wearer's foot. A steel toe is then positioned substantially around the toe part of the vamp lining.

This construction method combines the safety of a steel toe with the comfort of a shoe without an insole. In particular, the insole forepart advantageously provides a rigid support surface for attaching the steel toe at the toe portion of the shoe. Because the insole forepart is shorter in length than the sock,liner, remaining portions of the shoe construction are flexible in use. In order to ensure maximal comfort to the wearer, the insole forepart member preferably does not extend beyond the metatarsals.

Embodiments of this aspect of the invention may include one or more of the following features. After attaching the insole forepart to the sock liner, for example by stitching with a thread, a loose edge of the insole forepart is provided. This loose edge facilitates the attachment of the steel toe.

The loose edge is provided by stitching along a contour spaced a predetermined distance from a peripheral edge of a toe portion of the insole forepart. Specifically, the loose edge is a uniform portion for the steel toe to grasp.

A flange of the steel toe is placed under the loose edge of the insole forepart, thereby securing the position of the steel toe in relationship to the insole forepart and sock liner.

The insole forepart has a shape substantially the same as a peripheral edge of the sock liner at the toe portion, and the insole forepart is scaled proportionately smaller than the toe portion of the sock liner so that a peripheral edge of the insole forepart member is spaced from a peripheral edge of the sock liner at the toe portion. This spacing defines the area within which the steel toe is positioned.

Prior to positioning the steel toe, a cover is attached to the insole forepart, for example, with an adhesive. A rear edge of the cover is bevel skived. This cover is preferably made of a soft material to increase wearer comfort.

The insole forepart member has a length extending from the toe part to a metatarsal region of the sock liner. Thus, the relatively rigid insole forepart is limited solely to that part of the shoe where support for the steel toe is required. Remaining portions of the shoe corresponding, for example, to the arch and heel regions remain flexible.

The toe part of the vamp lining is stitched to a peripheral edge of the insole forepart by either closing stitching or strobel stitching. These two types of stitches are well suited for stitching edges together.

After positioning a last within the cavity defined by the vamp lining and insole forepart, the steel toe is adhesively attached to and around the toe part of the vamp lining. A strip of foam is then adhesively placed on the vamp lining next to a rear edge of the steel toe. This foam increases the wearer's comfort and prevents the steel toe from forming a visible ridge.

In another aspect, a footwear construction includes a sock liner with an insole forepart attached thereto (e.g. with stitching), and an upper with a vamp lining. A toe part of the vamp lining is stitched to a peripheral edge of the insole forepart, so that the vamp lining and the insole forepart define a cavity for receiving a wearer's foot. A steel toe is positioned substantially around the toe part of the vamp lining outside the cavity.

An embodiment may have the following feature. The insole forepart is skived at a bevel of 10–12 mm coming down to 0 mm thickness at a rear edge. This tapering eliminates an abrupt edge and increases the wearer's comfort.

Further aspects, features, and advantages will become apparent by the following.

DETAILED DESCRIPTION

Figure 1:
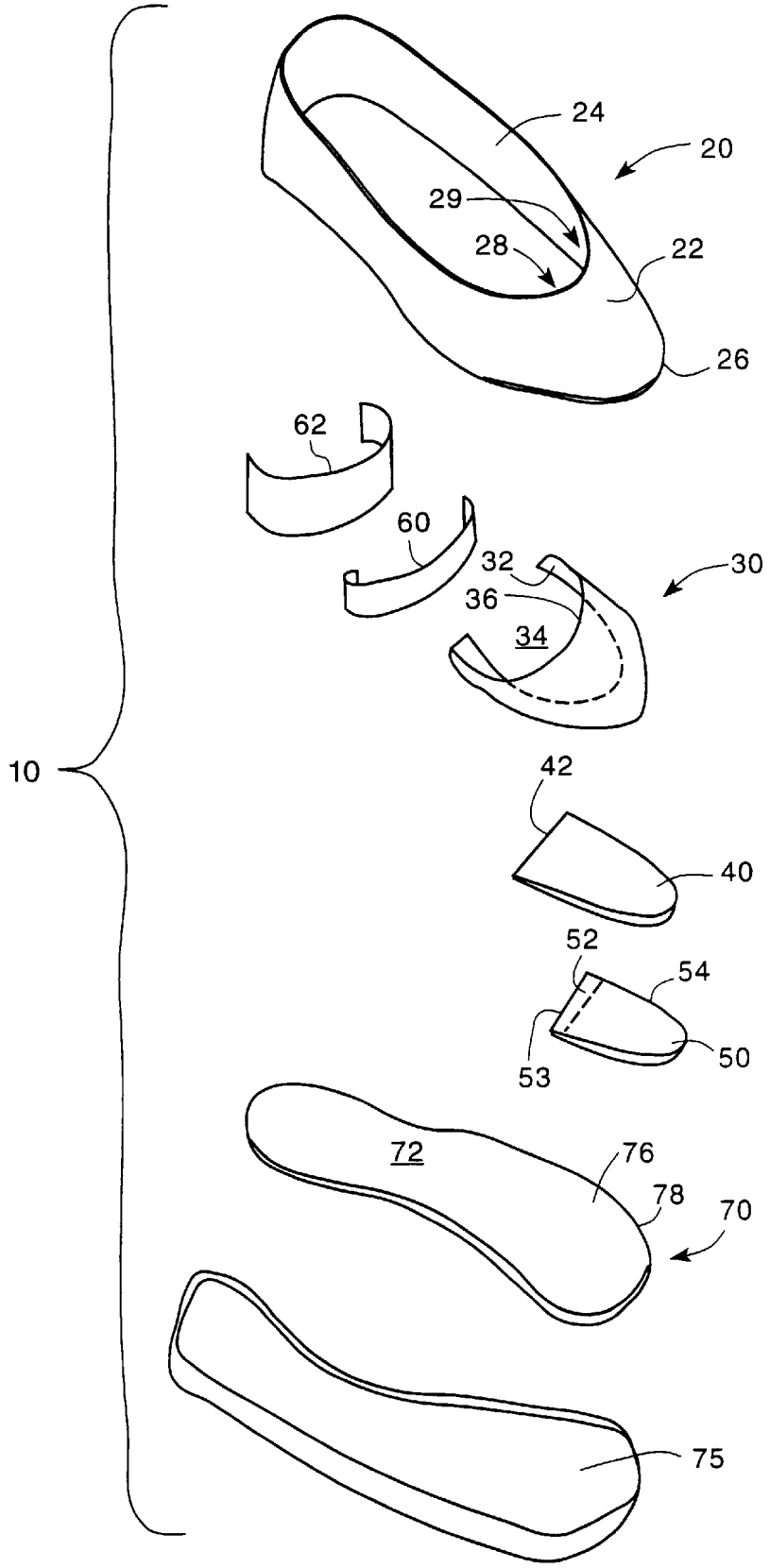
FIG. 1 is an exploded perspective view of the component parts of a shoe.
Figure 2:
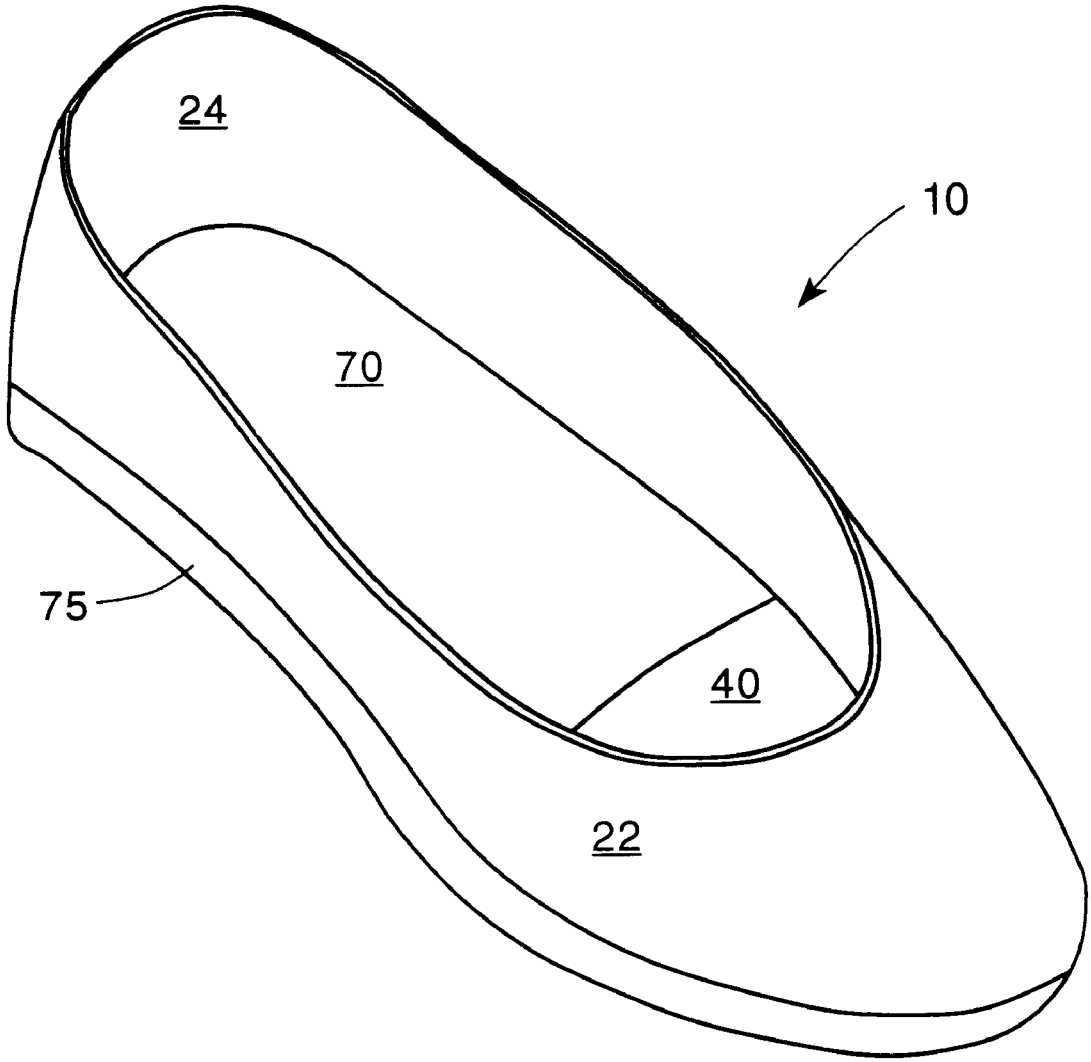
FIG. 2 is a perspective view of a shoe construction assembled from the components shown in FIG. 1.

Referring to FIGS. 1 and 2, a shoe 10 has a construction which is comfortable to wear and includes a steel toe 30 for protecting the wearer's toes from impact when used in harsh environments and is constructed using a modified Opanka shoe construction which is shown.

As will be described in greater detail below, in order to accommodate steel toe 30, an insole forepart 50 made of a relatively rigid material is provided to lend mechanical support to the steel toe at the forepart of shoe 10. Unlike conventional Opanka footwear, which does not include an insole, however, the shoe includes an insole forepart for supporting the steel toe.

In general, insole forepart 50 is first attached to a sock liner 70, and then insole forepart 50 is attached to a vamp lining 24 of shoe upper assembly 20. Insole forepart 50 and vamp lining 24, assembled in this manner, define a shell-like volume over which steel toe 30 is positioned.

Shoe upper assembly 20 is of the type having an upper 22, and vamp lining 24 sewn within upper 22. Upper 22 is made, for example, of leather while vamp lining 24 is fabricated from relatively soft materials, such as soft leather or plush fabric to provide comfort to the wearer during walking. Prior to being assembled with the remaining components of shoe 10, upper 22 and vamp lining 24 together roughly define the volume of shoe 10 within which the wearer's foot is placed. Shoe upper assembly 20 has a toe portion 26 with a cavity substantially defined by a toe portion 29 of vamp lining 24.

As stated above, insole forepart 50 is made from a relatively stiff insole board, such as fiberboard. Suitable fiberboard material can te obtained, for example, from Texon International Plc., Leicester, England. In the embodiment shown, the fiberboard has a 4 iron thickness (approximately 5/64" thickness). Insole forepart 50 has a shape substantially the same as a peripheral edge 78 of a toe portion 76 of sock liner 70. Insole forepart 50, however, is scaled proportionately smaller than toe portion 76 so that a peripheral edge 54 of the insole forepart 50 is generally equidistant from a peripheral edge 78 of toe portion 76, at a distance in a rangerf ¼" to ½". Insole forepart 50 is also somewhat longer than steel toe 30, so that the insole forepart provides a support surface for a flange 32 of steel toe 30. Insole forepart 50 has a proximal end 53 with a beveled edge 52 to minimize the steepness of a step between insole forepart 50 and sock liner 70, thereby increasing the wearer's comfort. Edge 52 has a bevel of 10–12 mm, decreasing to 0 mm thickness at proximal end 53 of edge 52 and is formed by skiving, for example using any of a variety of skiving machines, such as an Emazene skiving machine manufactured by USMC Machines, 400 Research Drive, Wilmington, Mass. 01887.

Insole forepart 50 has a length which is less than the length of sock liner 70 and depends on the length of steel toe 30. Thus, in order to maximize the wearer's comfort, the length of insole forepart 50 extends below the phalanges of the foot but should not extend to the metatarsals of the wearer's foot, i.e. the part of the foot between the phalanges and the tarsus.

Other components of shoe 10 include a cover 40, sock liner 70, and steel toe 30. Cover 40 is made, for example, from the same material as sock liner 70 and is sized to be 2–3 mm longer than insole forepart 50. A rear edge 42 of cover 40 is bevel skived, the bevel having a width which depends in part on the particular material of cover 40 and insole forepart 50 and varies generally between 2 mm and 5 mm.

Sock liner 70 is made out of leather or a leatherlike synthetic material. Steel toe 30 is made from forged steel, with flange 32 extending around a bottom edge. Steel toe 30 defines an opening 34, starting at a rear edge 36, sized to fit a wearer's foot. Opening 34 of steel toe 30 is sized to fit a last 90 (see FIG. 5).

With reference to FIGS. 3A, 3B, and 4–7, an approach for assembling steel toe 30 within shoe 10 will now be described.

Figure 3A:
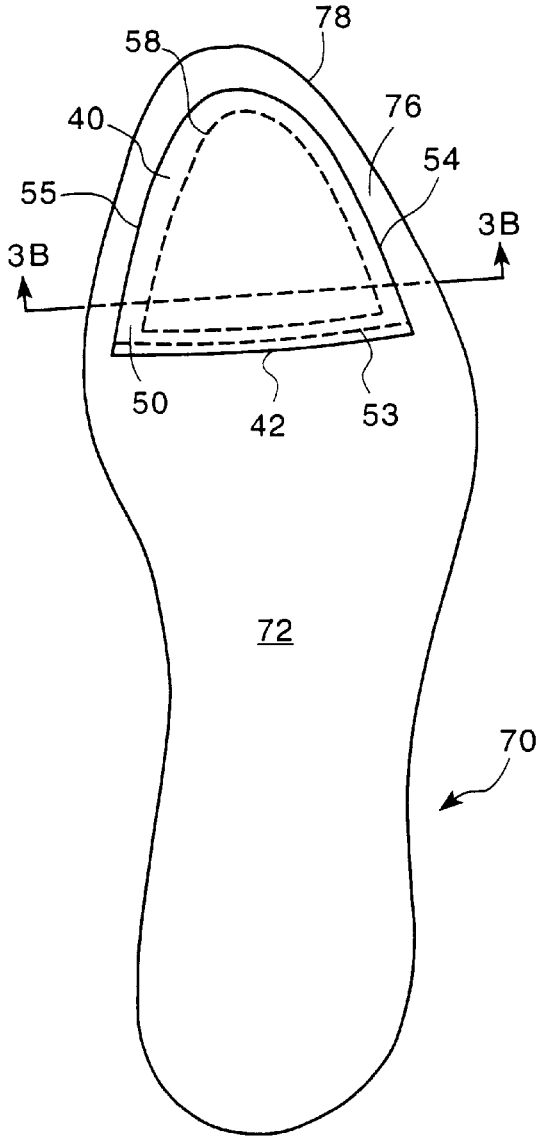
FIG. 3A is a top view of a sock lining with insole forepart in place.
Figure 3B:
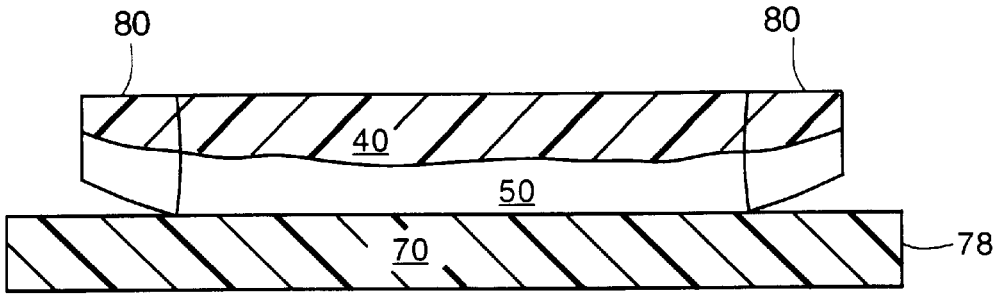
FIG. 3B is a cross-sectional view taken along line A—A of FIG. 3A (with the insole forepart and cover in place)

Referring first to FIGS. 3A and 3B, an inner surface 72 of toe portion 76 of sock liner 70 is marked with a reference mark 55 to indicate the desired positioning of insole forepart 50. The mark 55 made on sock liner 70 specifies an outline of the intended position of peripheral edge 54 of insole forepart 50, with the outer sides of the outline being generally parallel to and equidistant from a peripheral edge 78 of sock liner 70 at toe portion 76. As will become apparent later, insole forepart 50 must be precisely placed on sock liner 70 since the position of insole forepart 50 is critical in determining accurate positioning of steel toe 30. Cover 40 is adhesively attached to insole forepart 50, so that a 2–3 mm portion of rear edge 42 extends beyond peripheral side 53 of insole forepart 50. Cover 40 and insole forepart 50 are then placed on the reference mark 55 on sock liner 70, with insole forepart 50 being in contact with inner surface 72. Cover 40 is edge-stitched to sock liner 70 closely along rear edge 42. Cover 40 and insole forepart 50 are both stitched with a thread 58 to sock liner 70, approximately 10 mm±1 mm from a peripheral edge 54 of insole forepart 50. This stitching operation creates a loose edge 80, where insole forepart 50 and cover 40 are not attached to sock liner 70.

Figure 4:
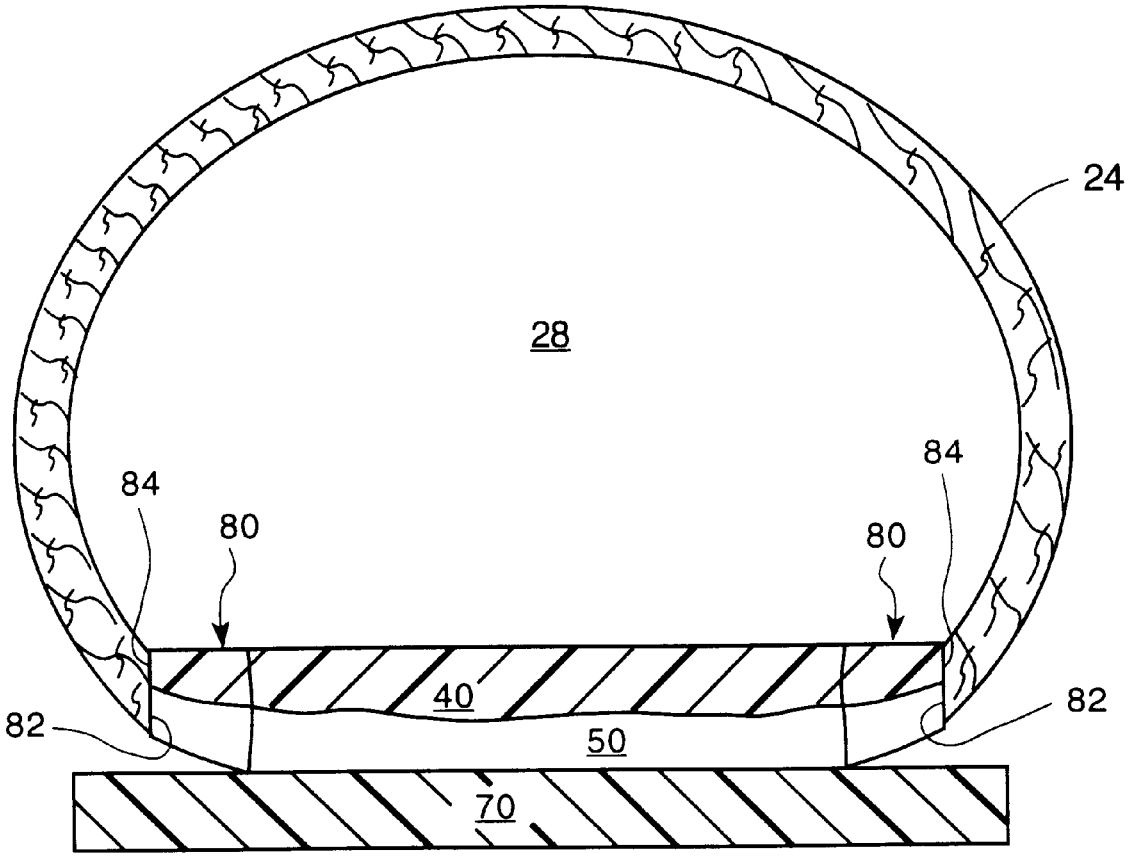
FIG. 4 is a cross-sectional view of a partially assembled shoe construction, shown with an attached vamp lining.

Referring to FIG. 4, toe portion 29 of vamp lining 24 is joined to loose edge 80 of cover 40 and insole forepart 50 using a closing stitch or strobel stitch. In the case of a closing stitch, vamp lining 24 is placed face-to-face with cover 40, and the two parts are stitched together with stitches 85 placed very close to an edge 82 of loose edge 80 and an edge 84 of vamp lining 24. Alternatively, in the case of a strobel stitch, edge 82 of loose edge 80 is held edge-to-edge with edge 84 of vamp lining 24, and a zig-zag stitch is used to sew edges 82, 84 together. By joining toe portion 29 of vamp lining 24 to loose edge 80, a cavity 28 for receiving a toe portion of the wearer's foot is formed.

Figure 5:
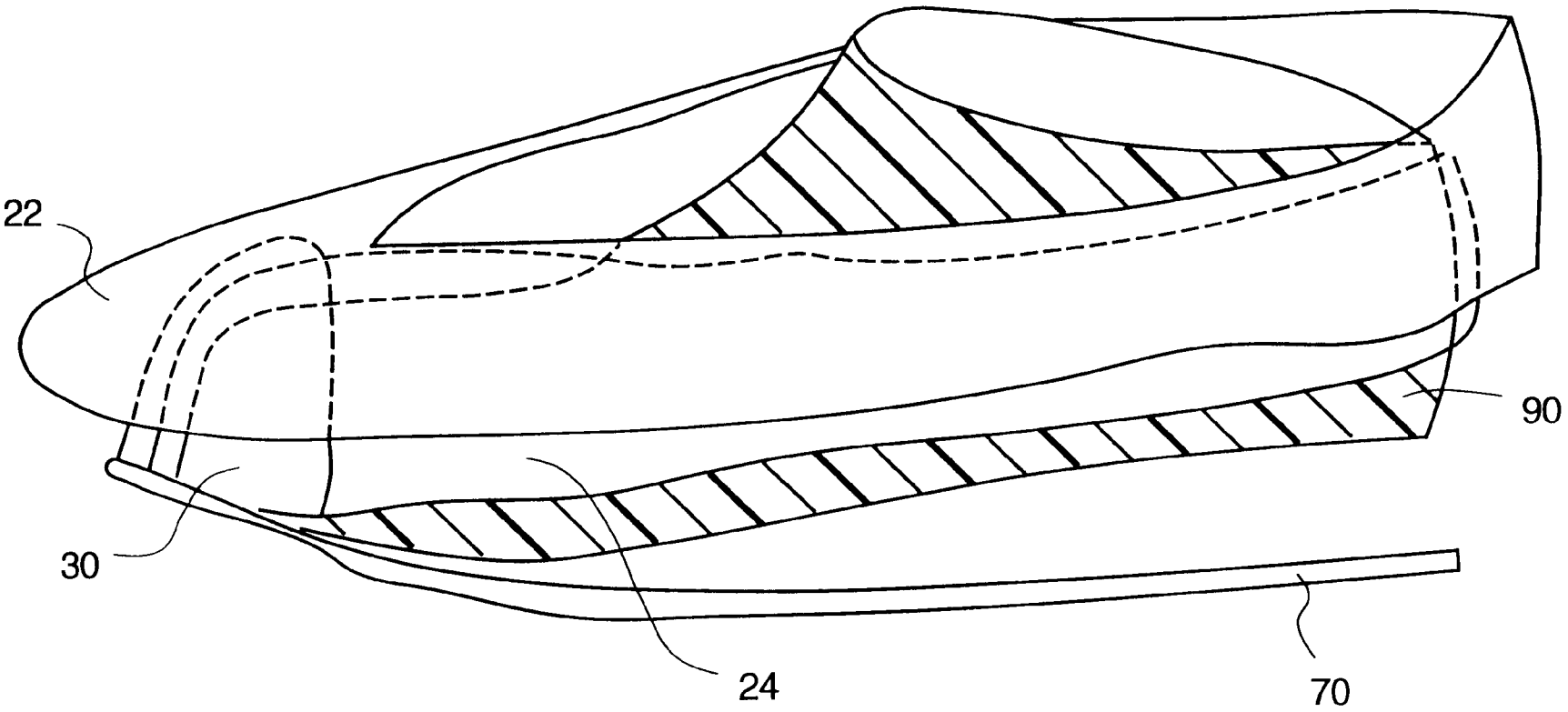
FIG. 5 is a perspective view of a partially assembled shoe construction, with a last inserted into a cavity formed in the toe portion of the shoe construction.
Figure 6:
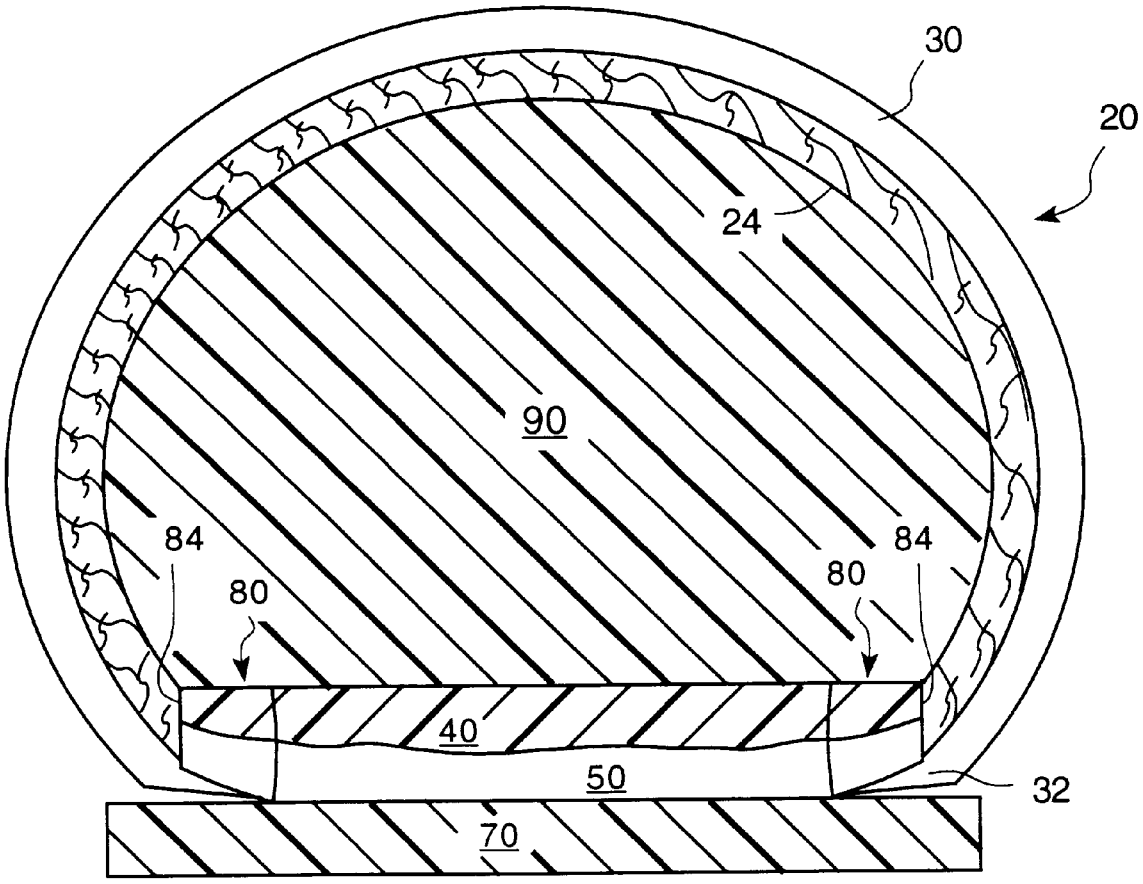
FIG. 6 is a cross-sectional view of a partially assembled shoe construction, with a steel toe attached to the vamp lining.

Referring to FIG. 5, last 90 is inserted into cavity 28 to expand vamp lining 24 to its desired shape. Referring also to FIG. 6, with shoe upper assembly 20 inserted over last 90, an adhesive is applied to steel toe 30 and/or vamp lining 24. Steel toe 30 is then slid over last 90 and vamp lining 24 to substantially surround toe portion 29 of vamp lining 24. Simultaneously, flange 32 of steel toe 30 is inserted under loose edge 80 of insole forepart 50. Thus, steel toe 30 is secured around vamp lining 24 and to insole forepart 50.

Figure 7:
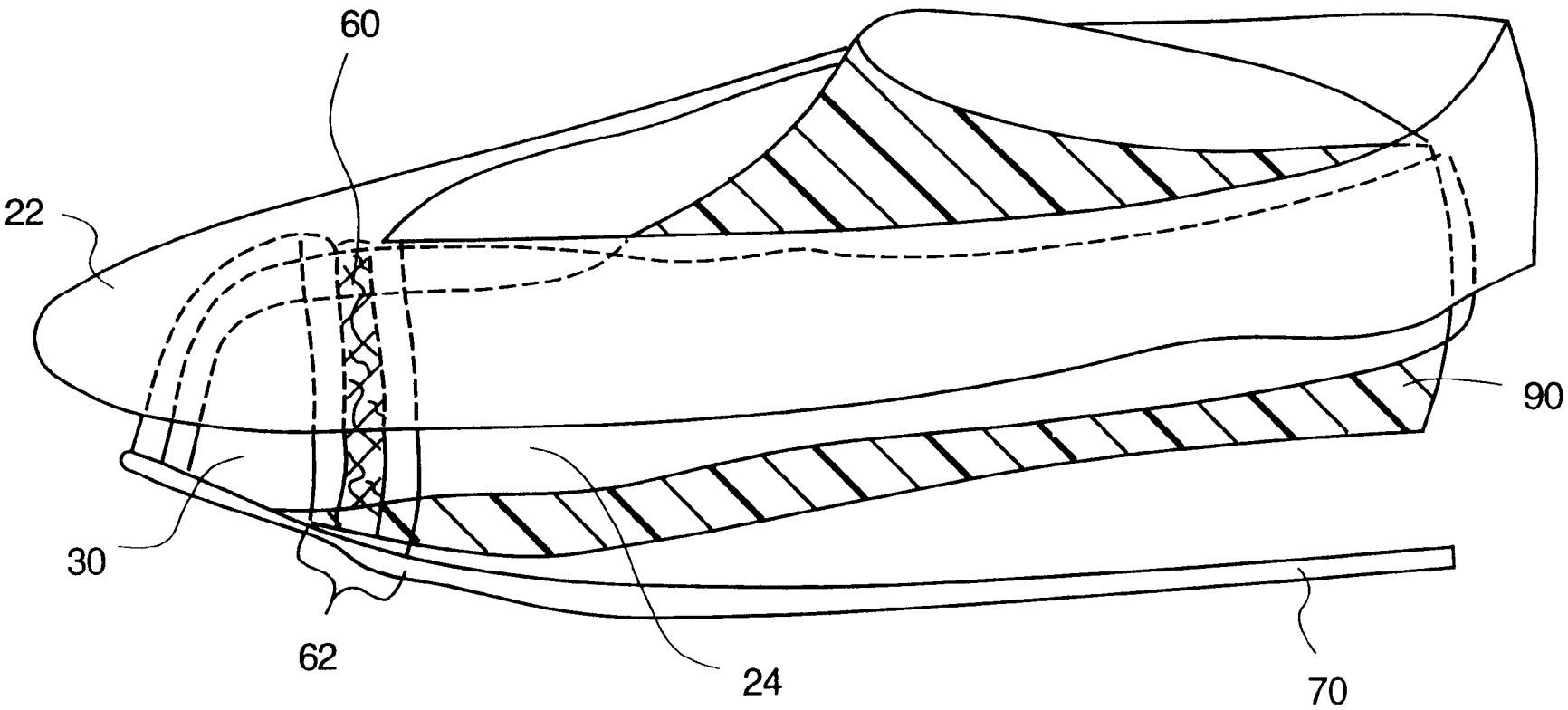
FIG. 7 is a perspective view of a partially assembled shoe construction positioned over a last.

Referring to FIG. 7, a strip of foam 60 is placed on top of vamp lining 24 adjacent to steel toe 30. Subsequently, foam strip 60 and rear edge 36 of steel toe 30 are covered with a strip of cloth tape 62, approximately 2" wide. This creates a smooth transition from steel toe 30 to vamp lining 24 and prevents an "x-ray effect" produced by a ridge showing through upper 22.

Finally, shoe upper assembly 20 is attached to an outsole 75 by hand sewing.

Other embodiments are within the following claims. For example, cover 40 does not need to be adhesively attached to insole forepart 50. Instead, cover 40 may be sewn to insole forepart 50, before attachment of insole forepart 50 to sock liner 70.

What is claimed is:

1. A footwear construction comprising:

a sock liner, a stiff insole forepart attached to the sock liner, a upper having a vamp lining, said upper having a toe part, the toe part of the vamp lining being stitched to a peripheral edge of the insole forepart, such that the vamp lining and the insole forepart define a cavity for receiving a wearer's foot, and a steel toe positioned substantially around the toe part of the vamp lining outside the cavity.

2. The footwear construction of claim 1, wherein the insole forepart member does not extend to a metatarsal region of the sock liner, the metatarsal region of the sock liner being the region of the sock liner proximate a metatarsal region of a wearer's foot, when said foot is fully inserted into said footwear.

3. The footwear construction of claim 2, further including a loose edge of the insole forepart, said loose edge being defined by a peripheral edge of the insole forepart, wherein said peripheral edge is not attached to the sock liner.

4. The footwear construction of claim 3, wherein the sock liner has a toe portion and the loose edge includes stitching along a contour spaced a predetermined distance from a peripheral edge of a toe portion of the insole forepart.

5. The footwear construction of claim 3, wherein the steel toe includes a flange placed under the loose edge.

6. The footwear construction of claim 3, wherein the insole forepart has a shape substantially the same as a peripheral edge of the sock liner at the toe portion, and the insole forepart is scaled proportionately smaller than the toe portion of the sock liner so that a peripheral edge of the insole forepart is spaced from a peripheral edge of the sock liner at the toe portion.

7. The footwear construction of claim 1, further comprising stitching for attaching the insole forepart to the sock liner.

8. The footwear construction of claim 1, further including a cover attached to the insole forepart.

9. The footwear construction of claim 8, wherein a rear edge of the cover is bevel skived.

10. The footwear construction of claim 1, further including a strip of foam adhesively placed on the vamp lining next to a rear edge of the steel toe.

11. A method for construction of footwear comprising:

providing an upper including a vamp lining disposed along an inner surface of the upper, said vamp lining having a toe part, attaching a stiff insole forepart member to a sock liner, the insole forepart having a length shorter than a length of the sock liner, stitching the toe part of the vamp lining to a peripheral edge of the insole forepart, the vamp lining and insole forepart defining a cavity for receiving a portion of a wearer's foot, and positioning a steel toe substantially around the toe part of the vamp lining.

12. The method of claim 11, wherein the insole forepart member does not extend to a metatarsal region of the sock liner, the metatarsal region of the sock liner being the region of the sock liner proximate a metatarsal region of a wearer's foot, when said foot is fully inserted into said footwear.

13. The method of claim 12, wherein the insole forepart has a shape substantially the same as a peripheral edge of the sock liner at the toe portion, and the insole forepart is scaled proportionately smaller than the toe portion of the sock liner so that a peripheral edge of the insole forepart is spaced from a peripheral edge of the sock liner at the toe portion.

14. The method of claim 11, wherein by attaching the insole forepart to the sock liner a loose edge of the insole forepart is provided, the loose edge being defined by a peripheral edge of the insole forepart that is not attached to the sock liner.

15. The method of claim 14, wherein providing the loose edge includes stitching along a contour spaced a predetermined distance from a peripheral edge of a toe portion of the insole forepart.

16. The method of claim 14, further including placing a flange of the steel toe under the loose edge of the insole forepart.

17. The method of claim 11, wherein attaching the insole forepart to the sock liner includes stitching a thread through the insole forepart and sock liner.

18. The method of claim 11, further including, prior to positioning the steel toe, attaching a cover to the insole forepart.

19. The method of claim 18, wherein a rear edge of the cover is bevel skived.

20. The method of claim 11, wherein stitching the toe part of the vamp lining to the peripheral edge of the insole forepart includes stitching selected from the group consisting of closing stitching and strobel stitching.

21. The method of claim 11, further including adhesively placing a strip of foam on the vamp lining next to a rear edge of the steel toe after positioning a steel toe substantially around the toe part of the vamp lining.

22. The method of claim 11, wherein attaching a stiff insole forepart member includes attaching said member to an inner surface of the sock liner.

23. The footwear construction of claim 1, wherein the stiff insole forepart is attached to an inner surface of the sock liner.

24. The method of claim 11, wherein the stiff forepart member comprises fiberboard.

25. The method of claim 11, wherein the stiff forepart member is approximately 4 iron thick.

26. The footwear of claim 1, wherein the stiff forepart member comprises fiberboard.

27. The footwear of claim 1, wherein the stiff forepart member is approximately 4 iron thick.

* * * * *

UNITED STATES PATENT AND TRADEMARK OFFICE

CERTIFICATE OF CORRECTION

PATENT NO. : 6,067,732

DATED : MAY 30, 2000

INVENTOR(S) : MICHAEL DODGE

It is certified that error appears in the above-identified patent and that said Letters Patent is hereby corrected as shown below:

Column 3, Line 28, delete "te" and insert --be--.
Line 37, delete "rangerf" and insert --range of--.

Column 4, Line 66, delete the first "a" and insert --an--.

Signed and Sealed this

Third Day of April, 2001

*Attest:*

NICHOLAS P. GODICI

*Attesting Officer*

*Acting Director of the United States Patent and Trademark Office*